United States Patent [19]

Pachmayr

[11] 4,162,586

[45] Jul. 31, 1979

[54] GUN WITH CUSHIONED GRIP SAFETY

[75] Inventor: Frank A. Pachmayr, Los Angeles, Calif.

[73] Assignee: Pachmayr Gun Works, Inc., Los Angeles, Calif.

[21] Appl. No.: 838,806

[22] Filed: Oct. 3, 1977

[51] Int. Cl.[2] ..... F41C 23/00

[52] U.S. Cl. ..... 42/71 P; 42/70 E; 42/74

[58] Field of Search ..... 42/71 P, 70 E, 70 R, 42/74, 7; 89/150

[56] References Cited

U.S. PATENT DOCUMENTS

| | | | |
|---|---|---|---|
| 319,020 | 6/1885 | Piffard | 42/71 P |
| 926,529 | 6/1909 | Wesson | 42/71 P |
| 984,519 | 2/1911 | Browning | 42/7 |
| 1,070,582 | 8/1913 | Browning | 42/70 R |
| 3,815,270 | 6/1974 | Pachmayr | 42/71 P |
| 4,043,066 | 8/1977 | Pachmayr et al. | 42/71 P |

FOREIGN PATENT DOCUMENTS

| | | | |
|---|---|---|---|
| 242165 | 12/1911 | Fed. Rep. of Germany | 42/70 E |

*Primary Examiner*—Charles T. Jordan
*Attorney, Agent, or Firm*—William P. Green

[57] ABSTRACT

A gun having a pistol type handle with a trigger at the front of the handle and a grip safety at the back of the handle mounted for limited pivotal movement and acting to prevent actuation of the trigger except when the grip safety is squeezed forwardly, and with the back surface of the grip safety being formed as a layer of cushioning material for contacting the user's hand.

8 Claims, 9 Drawing Figures

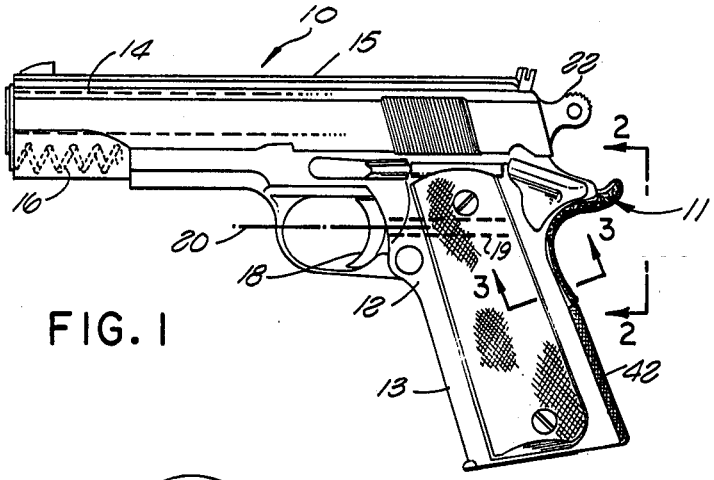
FIG. 1
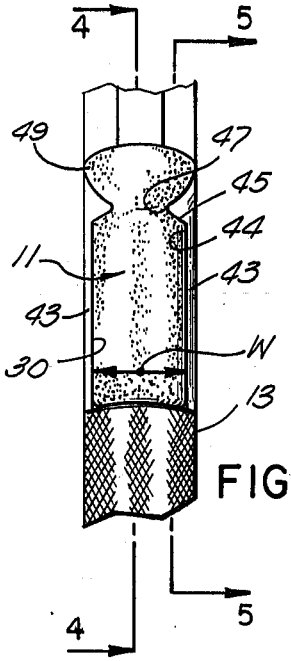
FIG. 2
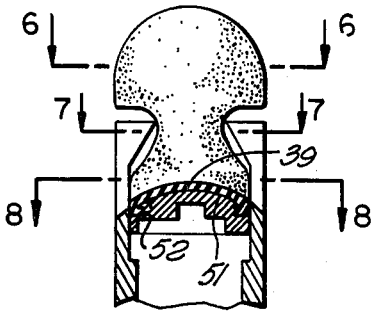
FIG. 3
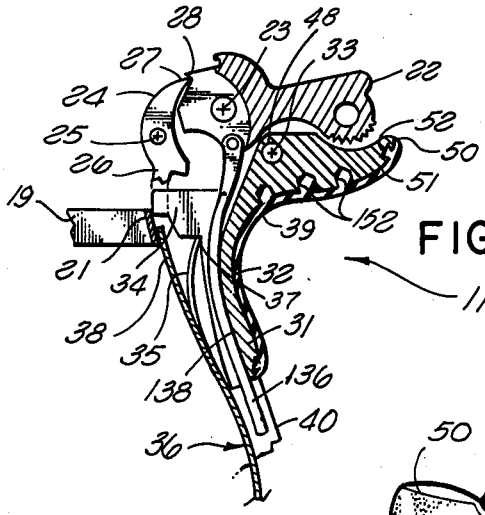
FIG. 4
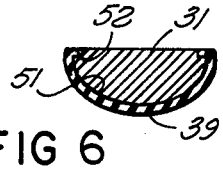
FIG 6
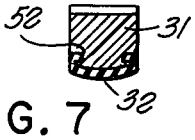
FIG. 7
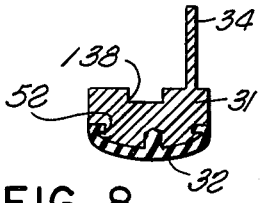
FIG. 8
FIG. 5
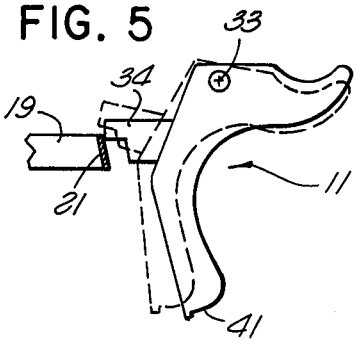
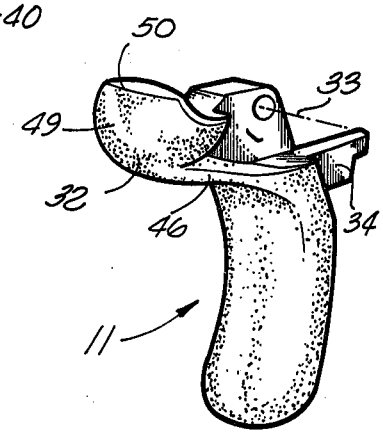
FIG 9

GUN WITH CUSHIONED GRIP SAFETY

BACKGROUND OF THE INVENTION

This invention relates to improvements in guns having pistol type handles, and particularly guns in which there is provided a 'grip safety', that is, an element at the back of the gun handle which must be squeezed forwardly by the user's hand before the trigger can be actuated to fire the gun.

There have in the past been provided cushioned grips for guns of this type, consisting of reinforced bodies of rubber secured to the handle of the gun for improving and cushioning the contact between the user's hand and the gun. For example, grips of this type are shown in U.S. Pat. No. 3,815,270, issued June 11, 1974. These prior grips have been purposely cut away, however, at the location of the grip safety element, in order to avoid interference with proper limited pivotal movement of that part and effective functioning of the gun. When such an arrangement is used for firing many rounds of ammunition, the exposed metal surface of the grip safety can cause discomfort to or irritation of the engaged portion of the user's hand, and may result in the development of heavy callouses at that particular location on the hand.

SUMMARY OF THE INVENTION

The present invention overcomes the above discussed problem by providing a grip safety element whose exposed hand contacting surface is itself formed of a cushioning material, to prevent discomfort or harm to the user's hand even after prolonged periods of use. The grip safety element is formed of a main rigid body part and a layer of rubber or other cushioning material desirably adhered continuously to the back surface thereof, as by vulcanization. To enhance the retention of the cushioning material, the rigid part may be irregularized and/or undercut, and desirably has an undercut groove extending along the periphery of the outer surface of the rigid part.

BRIEF DESCRIPTION OF THE DRAWING

The above and other features and objects of the invention will be better understood from the following detailed description of the typical embodiment illustrated in the accompanying drawing in which:

FIG. 1 is a side view of an automatic pistol having a grip safety constructed in accordance with the invention;

FIG. 2 is an enlarged fragmentary rear elevational view taken on line 2—2 of FIG. 1;

FIG. 3 is a view taken essentially on line 3—3 of FIG. 1, looking upwardly at the underside of the rearwardly projecting portion of the grip safety;

FIGS. 4 and 5 are vertical sections taken on line 4—4 and 5—5 respectively of FIG. 2;

FIGS. 6, 7 and 8 are sections taken on lines 6—6, 7—7 and 8—8 respectively of FIG. 3; and, FIG. 9 is a perspective representation of the grip safety element.

DESCRIPTION OF THE PREFERRED EMBODIMENT

The pistol 10 illustrated in the drawing is of the well-known and widely used 'colt' automatic type, and except with regard to the construction of the 'grip safety' element 11 may be completely conventional both structurally and operationally. The details of the gun will therefore not be described specifically except insofar as they relate to the grip safety 11.

To describe the overall structure of the gun very generally, it includes a main receiver or body section 12 having a downwardly projecting handle portion 13 and movably carrying a barrel 14 which upon firing of the gun retracts rearwardly and downwardly a short distance and causes rearward retraction of a slide 15 against the force of a recoil spring 16, with the slide serving to cock the hammer, eject the spent round, and advance a next successive round from a magazine in the handle into the barrel.

The trigger 18 for firing the gun is attached rigidly to and carried by a trigger loop 19, which is slidably guided by the receiver 12 for only front to rear movement relative to the receiver along an axis 20 parallel to the axis of the barrel 14. Loop 19 has a transverse rear portion 21 which upon rearward movement releases the spring urged hammer 22 for forward pivotal firing movement about the hammer axis 23 to fire a round in the barrel. Such release of the hammer is effected by counterclockwise pivotal movement of the sear 24 about its axis 25, with the portion 21 of loop 19 acting against the lower end 26 of the sear to cause movement of the upper edge 27 of the sear leftwardly away from locking engagement with shoulder 28 on the hammer element.

The grip safety element 11 is movably received within a recess 30 formed in the upper rear portion of handle 13, at a location beneath hammer 22. This safety element includes a first main rigid body part 31 normally formed of an appropriate metal such as steel or aluminum, and a layer of cushioning material 32 extending along and covering the rear surface of part 31. The part 31 is mounted for limited pivotal movement about an axis 33 extending parallel to pivotal axes 23 and 25 and extending transversely of the front to rear axis of the gun. This pivotal movement of grip safety 11 is between the active or normal full line position of FIG. 5 and the released broken line position of that figure, and acts to move a forwardly projecting lug 34 of part 31 slightly upwardly between its FIG. 5 full line position in which it is received opposite and engages and blocks rearward movement of trigger loop 19 and the connected trigger 18, and the upper broken line position of lug 34 in which the trigger and trigger loop can move rearwardly to fire the gun. Element 11 is actuated to its broken line position when a user grips and squeezes handle 13 in actuating the trigger. Element 11 is yieldingly urged pivotally to its full line position of FIG. 5 by one of three resilient tines 35 of a release spring 36, with the upper end of this tine engaging part 31 of grip safety element 11 at 37 to urge it in a counterclockwise direction to the full line position of FIG. 5. The upper end of a second resilient tine 38 of spring 36 acts against portion 21 of the trigger loop to yieldingly urge the trigger forward. At its forward side, the part 31 contains a groove 138 within which the hammer strut 136 extends downwardly for co-action with the usual main spring (not shown) for actuating the hammer in a firing direction.

The layer of cushioning material 32 with which the present location is particularly concerned is formed of an elastomeric material, desirably neoprene rubber, which is considerably softer than the rigid metallic element 31, to present a soft outer or rear cushioned surface 39 which is contacted by the user's hand at the grip safety location, and which prevents direct contact of the hand with the metal of part 31. Surface 39 in the active locking position of the grip safety 11 projects slightly rearwardly beyond a flush position with respect to the adjacent surfaces 40 of the gun handle, to be actuable by the user's hand when he squeezes the handle on firing.

To describe the structure of parts 31 and 32 of grip safety 11 in somewhat greater detail, it is noted that in extending upwardly from the lower extremity 41 of element 11, part 31 and layer 32 both first extend generally upwardly (and slightly forwardly) in correspondence with the general upward and forward inclination of the rear surface 42 of the handle. The width w (FIG. 2) of these lower generally vertically extending portions of part 31 and layer 32 is relatively wide, being defined by generally parallel opposite side edges 43 fitting closely within a fairly wide portion 44 of recess 30 in the gun handle. This width w continues upwardly to a location 45 at which reduced width portions 46 of parts 31 and 32 are confined closely within a reduced width portion 47 of the recess 30. At the location of its portion 46, part 31 contains an opening through which a pivot pin 48 extends for mounting the parts 31 and 32 for their discussed pivotal movement about axis 33 relative to the receiver or main body of the gun. Rearwardly beyond the reduced width neck 46, parts 31 and 32 have increased width rear portions 49 which project rearwardly beyond and fit closely about the rear extremity of the receiver, and whose peripheral edges are curved essentially circularly as shown in FIG. 3.

Referring to FIGS. 3, 6, 7 and 8, it is noted that surface 39 as seen in cross section in those figures is preferably smoothly rounded in cross section at all locations along its extent from the lower extremity 41 to the rear tip or edge 50. Similarly, the underlying outer surface 51 of metal part 31 is correspondingly rounded in cross section between the two (2) specified locations 41 and 50. Surface 51 is appropriately irregularized, as by sand blasting or the like, and the preferably rubber cushioning material 32 is continuously bonded to the entire surface 51 over its entire area, as by vulcanization at the time of curing of the rubber. The attachment of layer 32 to element 31 can be further enhanced by providing an undercut groove 52 in element 31, with this groove extending along the entire periphery of surface 51 as seen in the figures, so that the rubber of cushion 32 will upon vulcanization in place on part 31 extend into groove 52 and be cured therein and bonded to the walls of that groove in a manner forming an extremely effective interlock between the cushioning material and part 31 preventing the cushion from tearing loose from part 31 in use. This mechanical interlock can be further enhanced by providing recesses 152 in surface 51 of part 31, into which the elastomeric material may extend, and within which the elastomeric material may be bonded to part 31.

Each time that the gun is fired, the user squeezes grip safety 11 forwardly before actuation of the trigger, to swing surface 39 into more flush relationship with respect to the surrounding portion of the gun handle. The portion of the user's hand which contacts grip safety 11 engages only the relatively soft resiliently flexible surface 39 of cushion 32 and can deform that cushion slightly in a manner preventing irritation of the hand by contact with the grip safety even after prolonged repeated firing of the gun. The other exposed portions of the handle 13 are preferably also cushioned, as previously indicated, to enable the user to hold the gun in an extremely effective and reliable manner, without slippage, and to protect the hand at virtually all points against irritating contact with metal parts.

While a certain specific embodiment of the present invention has been disclosed as typical, the invention is of course not limited to this particular form, but rather is applicable broadly to all such variations as fall within the scope of the appended claims.

I claim:

1. A gun comprising:

a handle;

a trigger at the front of said handle adapted to be actuated rearwardly;

means for firing a cartridge upon movement of the trigger; and, a grip safety element at the rear of said handle which is mounted for slight forward movement by the hand of the user when he squeezes the handle and actuates the trigger, and which is constructed to prevent rearward cartridge firing movement of the trigger when the grip safety element is in a rear active position, but to permit such rearward movement of the trigger when the grip safety element is in a forward released position to which it is displaced by squeezing of the handle;

said grip safety element including a rigid part and a layer of softer cushioning material carried by said part at the back side thereof for engaging the user's hand and cushioning the contact therewith.

2. A gun as recited in claim 1, in which the cushioning material is rubber.

3. A gun as recited in claim 1, in which said layer of cushioning material substantially completely covers and cushions said rigid part at all locations at which said element is exposed to contact with the user's hand.

4. A gun as recited in claim 1, in which said layer of cushioning material is bonded continuously to a surface of said rigid part.

5. A gun as recited in claim 1, in which said rigid part is undercut near a peripheral edge thereof to receive said cushioning material in interlocking relation.

6. A gun as recited in claim 1, in which said rigid part has a lower relatively wide portion and an upper rearwardly projecting relatively wide portion, with an intermediate narrower portion, said cushioning material covering outer surfaces of all three of said portions of the rigid part.

7. A gun as recited in claim 1, in which said rigid part has a lower relatively wide portion and an upper rearwardly projecting relatively wide portion, with an intermediate narrower portion, said cushioning material covering outer surfaces of all three of said portions of the rigid part, said upper portion of the rigid part having a generally circularly curving peripheral edge containing an undercut groove, said cushioning material being rubber which is bonded to said rigid part and extends into said groove in interlocking relation.

8. A gun as recited in claim 1, in which said rigid part has a lower relatively wide portion and an upper rearwardly projecting relatively wide portion, with an intermediate narrower portion, said cushioning material covering outer surfaces of all three of said portions of the rigid part, said rigid element containing an undercut groove extending along the periphery of all three of said portions of the rigid element, said cushioning material being rubber bonded continuously to outer surfaces of all three of said portions of said rigid element and extending into said groove in interlocking relation.

* * * * *